US008434752B2

(12) United States Patent
Tassinari et al.

(10) Patent No.: US 8,434,752 B2
(45) Date of Patent: May 7, 2013

(54) APPARATUS FOR OPENING AND TRANSPORTING A PRODUCT WITH A NON-SYMMETRICAL FOLD

(75) Inventors: Peter Roy Tassinari, Kennebunkport, ME (US); Heiner Luxem, Durham, NH (US)

(73) Assignee: Goss International Americas, Inc., Durham, NC (US)

( * ) Notice: Subject to any disclaimer, the term of this patent is extended or adjusted under 35 U.S.C. 154(b) by 43 days.

(21) Appl. No.: 13/204,156

(22) Filed: Aug. 5, 2011

(65) Prior Publication Data

US 2013/0032987 A1 Feb. 7, 2013

(51) Int. Cl.
*B65H 5/30* (2006.01)

(52) U.S. Cl.
USPC ..... 270/52.24; 270/52.23; 270/52.19

(58) Field of Classification Search ..... 270/52.14, 270/52.16, 52.19, 52.23, 52.24, 52.25
See application file for complete search history.

(56) References Cited

U.S. PATENT DOCUMENTS

| | | | | |
|---|---|---|---|---|
| 4,723,770 | A * | 2/1988 | Seidel et al. | 270/52.2 |
| 5,269,504 | A * | 12/1993 | Backman | 270/52.2 |
| 5,823,320 | A * | 10/1998 | Seidel et al. | 198/803.5 |
| 6,691,996 | B2 * | 2/2004 | Kaya et al. | 270/52.25 |
| 6,830,241 | B1 * | 12/2004 | Klopfenstein | 270/52.25 |
| 8,191,883 | B2 * | 6/2012 | Bader et al. | 270/52.14 |

* cited by examiner

*Primary Examiner* — Patrick Mackey
(74) *Attorney, Agent, or Firm* — Davidson, Davidson & Kappel, LLC

(57) ABSTRACT

A method for transporting newspapers includes the steps of feeding an asymmetrically folded multiple section newspaper into a pocket of a pocket conveyor of an inserting machine, wherein the asymmetrically folded multiple section newspaper has an extended lap having a height of at least 15% of a height of the asymmetrically folded newspaper when unfolded. A face of a first section of the headline side of the newspaper, when fed into the pocket is adjacent a movable wall of the pocket, and a back of a last section of the headline side of the newspaper adjacent a fixed wall of the pocket. The method further comprises feeding one or more inserts from a hopper to the pocket, where the inserts are fed into an opening between newspaper sections, removing the newspapers with the inserts therein from the pocket with a gripper conveyor, and releasing the newspapers with the inserts from the gripper conveyor headline up on a lapped stream conveyor.

11 Claims, 9 Drawing Sheets

APPARATUS FOR OPENING AND TRANSPORTING A PRODUCT WITH A NON-SYMMETRICAL FOLD

This application relates to the field of printing and in particular to the field newspaper inserters.

BACKGROUND INFORMATION

Newspaper inserters are well known in the art. Typically, a newspaper inserter feeds inserts, such as sheets or folded advertisements, into a pocket containing a newspaper jacket. A newspaper jacket is a folded section or sections of a newspaper into which the inserts are fed. Exemplary newspaper inserters are described in U.S. Pat. Nos. 6,907,316, 6,674,073, 6,082,724, 5,911,416, and 4,477,067, the entire disclosures of which are hereby incorporated by reference. The newspaper, with its inserts, can then be removed from the pocket by a gripper conveyor and then dropped in a shingled configuration on a lapped stream conveyor.

Conventional newspaper jackets have a symmetrical fold, meaning that the newspaper is folded substantially in half so that the difference between the two sides is generally less than 5%. This difference, often called the lap, is used to open the newspaper jacket so that inserts are fed into the open fold. Conventionally, the longer side of the jacket is held against one wall of the pocket by a clamp, as illustrated, for example in U.S. Pat. No. 4,477,067.

US 2009/0282998A1, hereby incorporated by reference in its entirety, describes a printing press and folder which produces a newspaper with an asymmetrical fold. As example, a newspaper having a length of 14.67 inches may be folded to have a 10.5 inch side and a 4.17 inch side. With this type of format, however, inserts fed into the open fold are less secure and more prone to falling out of the newspaper during processing in the plant and subsequent delivery to customers than a conventional symmetrically folded newspaper.

BRIEF SUMMARY OF THE INVENTION

In accordance with an embodiment of the present invention, a method for transporting newspapers includes the steps of feeding an asymmetrically folded multiple section newspaper into a pocket of a pocket conveyor of an inserting machine, wherein the asymmetrically folded multiple section newspaper has an extended lap having a height of at least 5% of a height of the asymmetrically folded newspaper when unfolded. A face of a first section of the headline side of the newspaper, when fed into the pocket is adjacent a movable wall of the pocket, and a back of a last section of the headline side of the newspaper adjacent a fixed wall of the pocket. The method further comprises applying a vacuum from a suction opening on the fixed pocket wall, thereby holding a last section of the headline side of the newspaper against the fixed wall of the pocket, moving a gripper mounted on the pocket to secure the last section the headline side of the newspaper against the fixed wall of the pocket, and moving the movable pocket wall away from the fixed pocket wall while applying a vacuum from a suction opening on the movable pocket wall, thereby holding at least the first section of the headline side of the newspaper against the movable pocket wall. The method further comprises feeding one or more inserts from a hopper to the pocket, where the inserts are fed into an opening between newspaper sections, removing the newspapers with the inserts therein from the pocket with a gripper conveyor, and releasing the newspapers with the inserts from the gripper conveyor headline up on a lapped stream conveyor.

In accordance with another embodiment of the present invention, an inserting machine comprises a pocket conveyor having a plurality of interconnected pockets. Each pocket has a fixed pocket wall, a movable pocket wall, a first side gripper, a second side gripper, a center gripper located between the first and second side grippers, at least one first suction opening on the fixed pocket wall and at least one second suction opening on the movable pocket wall. The at least one first suction opening and said at least one second suction opening are coupled to at least one vacuum source (i.e. they can be coupled to the same or different vacuum sources). The inserting machine further includes a plurality of hoppers located above the pocket conveyor. These hoppers are positioned to feed inserts to the pockets in the pocket conveyor. The inserting machine also includes set of actuators for separately controlling movement of the movable pocket wall, the first side gripper, the second side gripper, and the center gripper, and for separately controlling application of a vacuum to the at least one first and second suction openings.

BRIEF DESCRIPTION OF THE DRAWINGS

The present invention will be further described with respect the following Figures, in which:

FIG. 3(*b*) shows a perspective view of the pocket of FIG. 3(*a*) from a perspective which is downstream of the pocket;

FIG. 3(*c*) shows a top view of the pocket of FIGS. 3(*a*) and 3(*b*).

FIG. 4(*b*) shows a side perspective view of eight interconnected pockets of FIGS. 3(*a*) through 3(*c*).

DETAILED DESCRIPTION OF A PREFERRED EMBODIMENT

As explained above, when a newspaper jacket has an asymmetrical fold, inserts fed into the open fold are less secure and more prone to falling out of the newspaper during processing in the plant and subsequent delivery to customers than a conventional symmetrically folded newspaper. Another problem associated with an asymmetrically folded newspaper is that when these products are placed on a belt conveyor by a gripper conveyor after being removed from the inserter pocket, successive papers may become interleaved, as the spine of one newspaper enters into the fold of an adjacent newspaper.

In accordance with a preferred embodiment of the present invention, these problems are solved by feeding the newspaper jackets "headline up" into the inserters and then, in the inserter, feeding the inserts between sections of the newspaper instead of feeding them into an open fold.

Figure 1A:
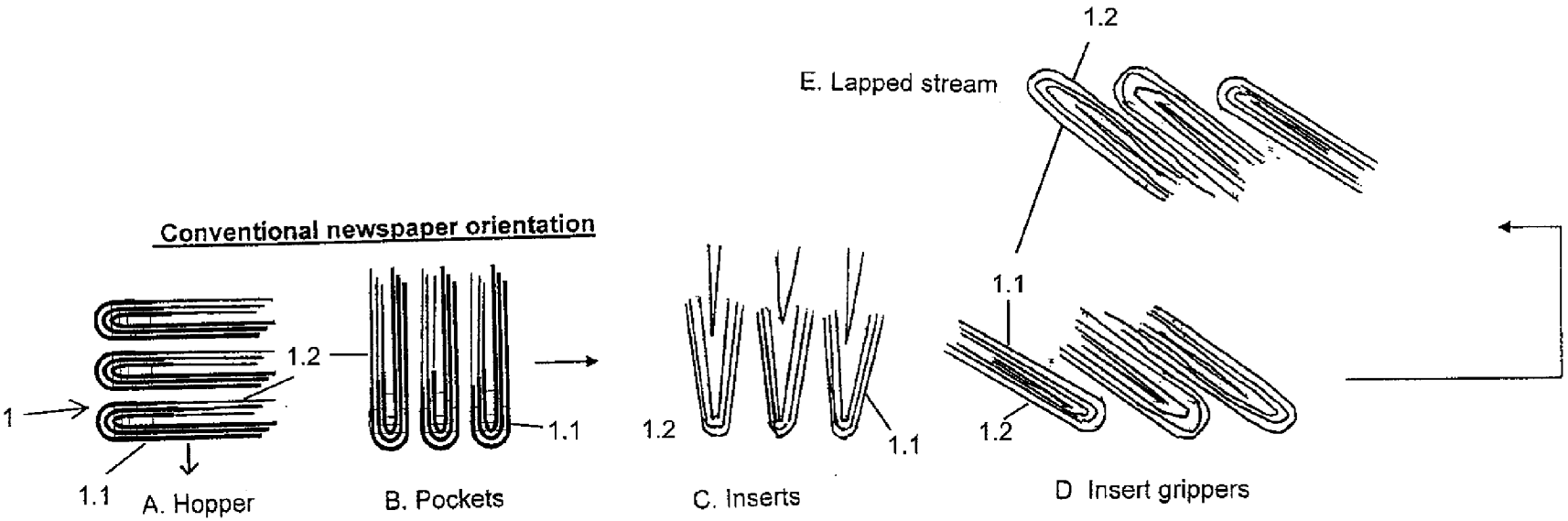
FIGURE 1(a) (Prior Art)
FIG. 1(A) shows a prior art process for feeding inserts into a conventional newspaper and transporting the newspaper to a shingled headline down stream conveyor.

Conventionally, newspapers are fed into an inserter "headline down", and downstream of the inserter, travel headline down in a lapped stream and are thereafter stacked headline down in a stacker. FIG. 1(A) graphically illustrates a conventional inserting process. In this illustration, the position of the newspapers as they travel through the process is shown, while the equipment processing the newspapers (hoppers, pockets, grippers, and lapped stream conveyor) are omitted. Newspapers 1 are loaded into a hopper (also known in the art as a "feeder") of an inserting machine with the top "headline side" 1.1 down and the bottom "below the fold" side 1.2 facing up (Step A). The hopper feeds the newspaper 1 into a pocket traveling below the hopper so that the headline side 1.1 is facing the fixed leading wall of the pocket (Step B). In an opening section of the inserting machine, the newspapers in the pockets are opened, and inserts are then inserted into the opened newspapers by downstream hoppers (Step C). After all of the inserts have been inserted into the pockets, the bottom of the pocket is opened, and the newspapers, with the inserts inserted therein, are grasped by grippers (Step D). The grippers then transport the newspapers and then release them onto a lapped stream conveyor (Step E).

Figure 1B:
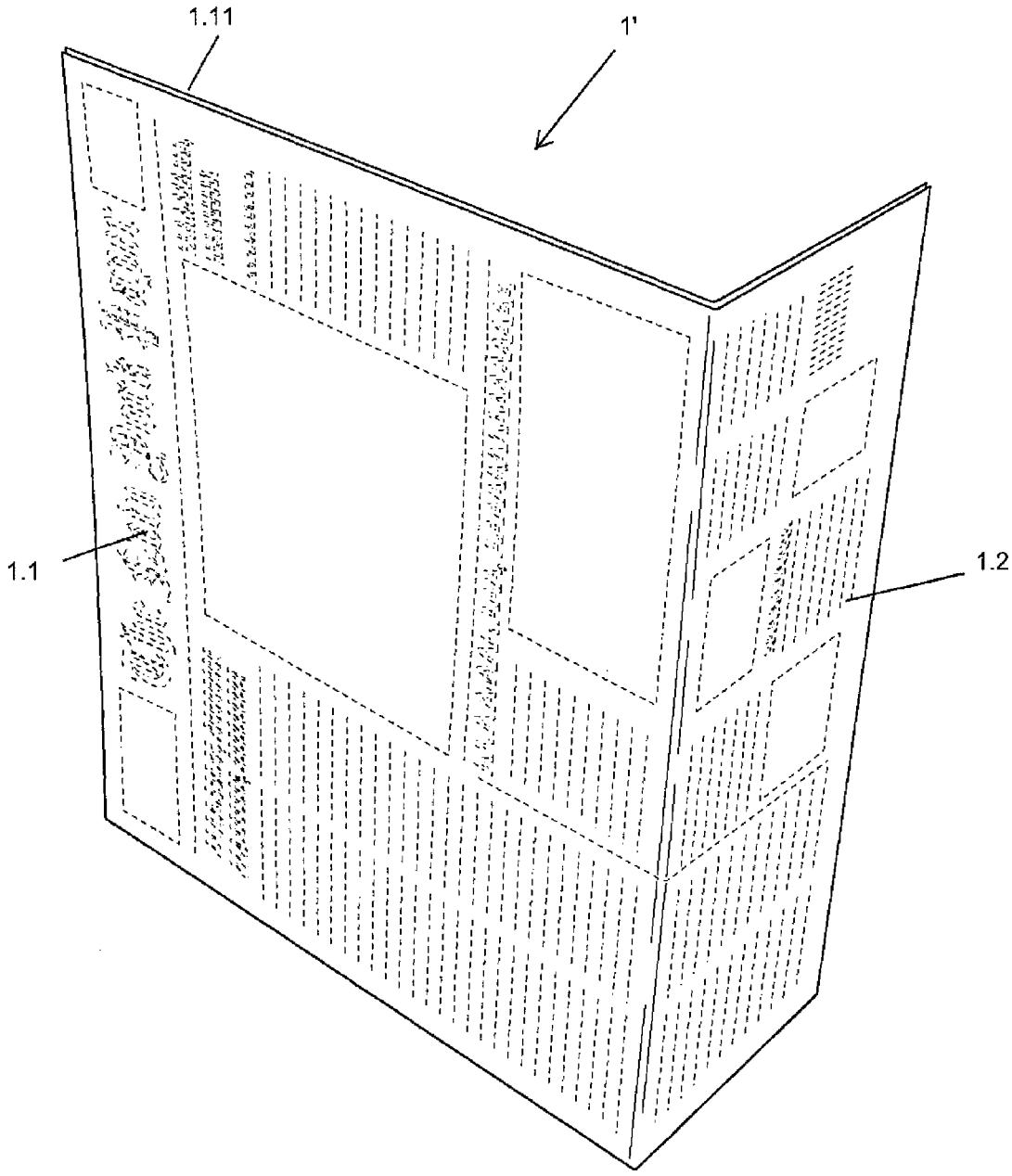
FIG. 1(B) shows an asymmetrically folded newspaper.

FIG. 1(B) illustrates an asymmetrical newspaper 1', with a long (headline) side 1.1, a short side 1.2, and a back 1.11 of the headline side 1.1.

Figure 1C:
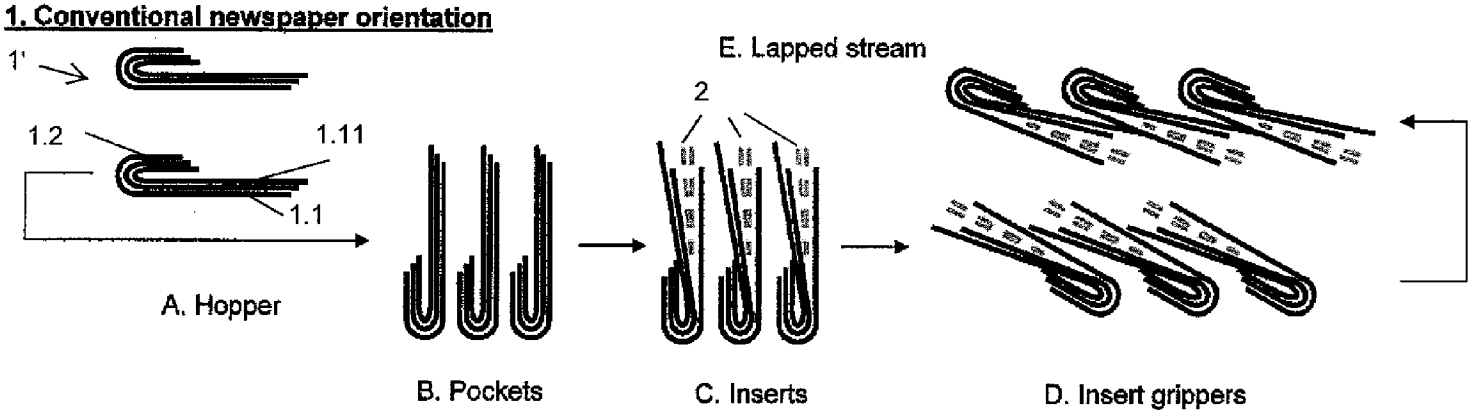
FIG. 1(C) shows a process for feeding inserts into an asymmetrically folded newspaper and transporting the newspaper to a shingled headline down stream conveyor.

FIG. 1(C) illustrates the same "headline down" inserting process for an asymmetrically folded newspaper 1'. The process is the same in steps 1(A) and 1(B). In step 1(C), instead of placing the inserts in the fold as in FIG. 1(*a*), the inserts 2 are placed in between sections of the newspaper as shown in 1(C) in accordance with an embodiment of the present invention. In step 1(E), a problem arises in that adjacent newspapers may become interleaved because the fold of one asymmetrically folded newspaper rests on the interior (or back face) 1.11 of the long side of the adjacent asymmetrically folded newspaper and thus can be pushed under the bottom (short) side 1.2 of the adjacent newspaper. This problem does not arise with a conventional newspaper, as illustrated in FIG. 1(A), because the fold of one newspaper rests on the bottom side of the adjacent newspaper.

Figure 1D:
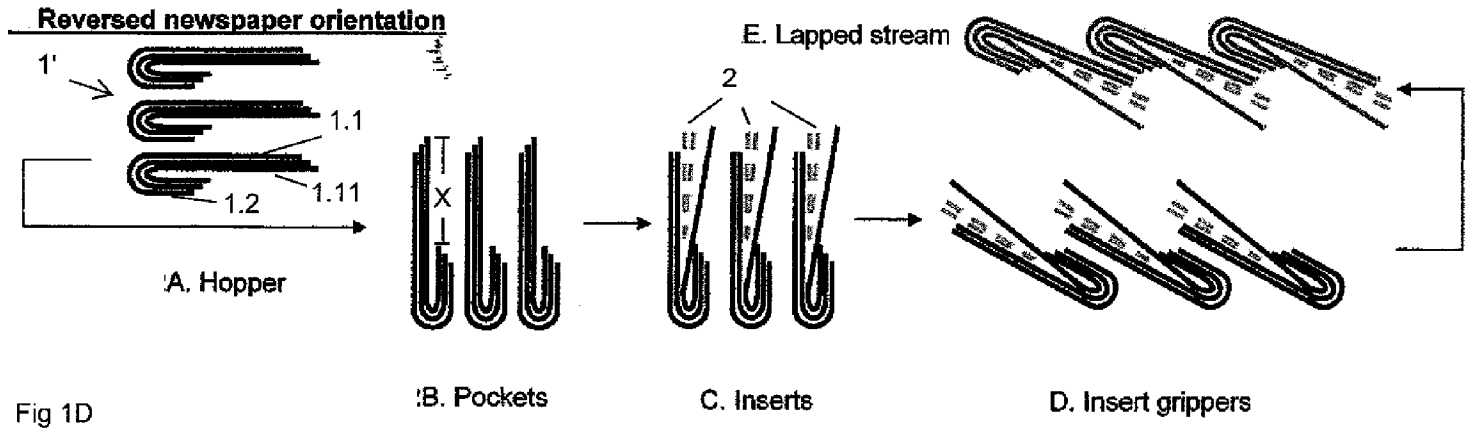
FIG. 1(D) shows a process for feeding inserts headline up into an asymmetrically folded newspaper and transporting the newspaper to a shingled headline up stream conveyor.

FIG. 1(D) illustrates the process in accordance with a preferred embodiment of the present invention in which the asymmetrically folded newspapers 1' are processed headline up during the inserting process and the inserts 2 are placed between sections of the newspaper. The process is the same as FIG. 1)(B), except the orientation of the newspaper is reversed, so that the newspaper is processed headline up. As shown in step 2(*e*), when the newspapers are processed headline up, the fold of one asymmetrically folded newspaper rests on the headline side 1.1 of the top (long) side of the adjacent newspaper. In this manner, adjacent newspapers will not become interleaved.

As used herein, an asymmetrically folded newspaper is defined as a folded newspaper having an extended lap having a height of at least 5% of a height of the asymmetrically folded newspaper when unfolded. Referring to FIG. 1(D), an asymmetrically folded newspaper is shown having an extended lap having a height "X" that is about 45% of the height of the asymmetrically folded newspaper when unfolded, wherein "X" is defined as difference between the height of side 1.1 and the height of side 1.2 as shown in FIG. 1B. Exemplary dimensions for an asymmetrically folded newspaper are set forth below, along with the corresponding extended lab height:

| Unfolded Height of Newspaper 1 (inches) | Headline Side 1.1 (inches) | Bottom Side 1.2 (inches) | Extended Lap (inches) | Extended Lap (%) |
|---|---|---|---|---|
| 14 | 10.5 | 3.5 | 7 | 50% |
| 14 | 10.0 | 4 | 6 | 42.8% |
| 14 | 11 | 3 | 8 | 57.14% |
| 14.67 | 10 | 4.67 | 5.33 | 36.33% |
| 14.67 | 10.5 | 4.17 | 6.33 | 43.15% |
| 14.67 | 11 | 3.67 | 7.33 | 49.96% |
| 15.17 | 10 | 5.17 | 4.83 | 31.84% |
| 15.17 | 10.5 | 4.67 | 5.83 | 38.43% |
| 15.17 | 11 | 4.17 | 6.83 | 45..02% |
| 15.71 | 10 | 5.71 | 4.29 | 27.31% |
| 15.71 | 10.5 | 5.21 | 5.29 | 33.67% |
| 15.71 | 11 | 4.71 | 6.29 | 40.04% |
| 16.54 | 10 | 6.54 | 3.46 | 20.92% |
| 16.54 | 10.5 | 6.04 | 4.46 | 26.96% |
| 16.54 | 11 | 5.54 | 5.46 | 33.01% |

Preferably, X is greater than or equal to about 15% of the height of the asymmetrically folded newspaper when unfolded, and less than or equal to about 70% of the height of the asymmetrically folded newspaper when unfolded, and preferably between about 20% and about 60% of the height of the asymmetrically folded newspaper when unfolded.

Figure 2A:
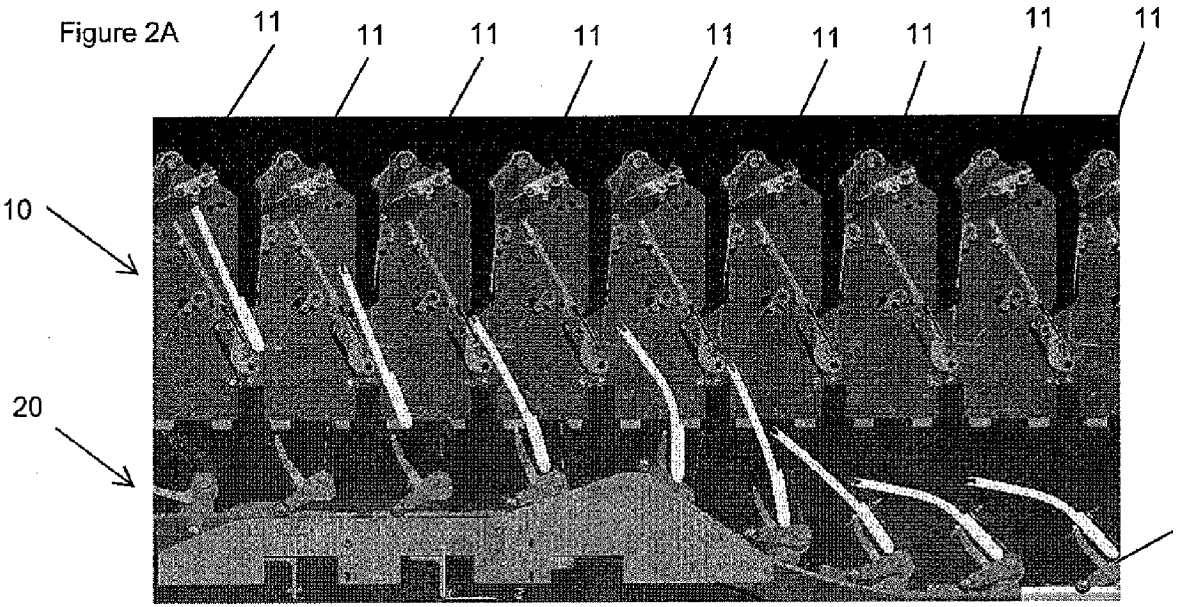
FIGS. 2(A) and 2(B) show steps (d) and (e) of FIG. 1(D) in more detail.
Figure 2B:
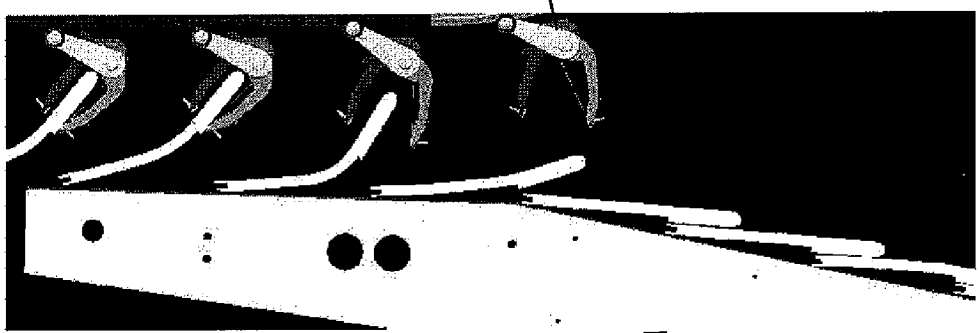

FIG. 2(*a*) shows pocket conveyor 10 including a plurality of pockets 11, and a gripper conveyor 20 including a plurality of grippers 21 for gripping newspapers as they are released from a bottom of the pockets 11. FIG. 2(*b*) shows the grippers 21 of the gripper conveyor 20 releasing newspapers to a remotely located lapped stream conveyor 30. As one of ordinary skill in the art will appreciate, the lapped stream conveyor 30 may be in a different part of the mailroom (or even in a different part of the building) from the inserting machine, and the gripper conveyor 20 may transport the newspapers along the ceiling of the mailroom so that it does not take up floor space or impede the movement of personnel or equipment in the mail room.

In accordance with an embodiment of the present invention, a pocket conveyor is provided which can process conventional newspapers headline down as well as asymmetrical newspapers headline up. In accordance with this embodiment, in each moveable pocket on the pocket conveyor, one or more suction openings are provided on the top half of both a fixed wall of the pocket and a moveable wall of the pocket. In addition, the pocket includes a first side gripper, a second side gripper, and a center gripper. The pockets are moveable on the pocket conveyor in a conventional manner, such as on one or more rails. Selective movement of the moveable wall, first side gripper, second side gripper, and center gripper, and selective actuation of the vacuum for the suction openings can be made in any known manner using conventional actuators. As an example, cam followers can be employed to selectively move the moveable wall, first side gripper, second side gripper, and center gripper, with the cam followers actuated by cams positioned at appropriate locations in the inserting machine. Similarly, cam followers can be used to open or close a valve to provide or remove a vacuum to the suction openings.

The process of feeding newspapers into the pockets, and then opening the newspapers to receive inserts will now be described. The newspapers are fed into the pockets in any known manner. For example, they can be fed into the pockets by a jacket hopper, or can be dropped into the pockets directly from an upstream gripper conveyor. Once the newspaper is in the pocket, the newspaper is opened in an opening section of the inserter. As known in the art, the opening section of the inserter includes a rotating brush which rotates in the direction of travel of the pockets, but at a surface speed greater than the speed of the pocket movement. When a pocket reaches the opening section of the inserter, the brush biases the newspaper against the fixed wall of the pocket and the suction openings on the fixed pocket wall is actuated, e.g. by a vacuum valve, so that an adjacent side of the newspaper is held to the fixed pocket wall.

Referring to FIG. 1(*a*), if a conventional newspaper was fed headline down into the hopper, when the suction opening on the fixed pocket wall is actuated and the face of the headline side 1.1 of the newspaper will be held to the fixed pocket wall. Referring to FIG. 1(*e*), if an asymmetrical newspaper was fed headline up into the hopper, when the suction opening on the fixed wall is actuated, the back 1.11 of the of the headline side 1.1 will be held to the fixed pocket wall because the suction openings are placed on the top half of the fixed pocket wall. Then, either the first side gripper or the second side gripper is actuated, depending on whether the newspaper is conventional or asymmetric. In this regard, the side gripper closest to the spine of the newspaper is actuated.

For a conventional newspaper fed headline down, this will be the side gripper located on the right side of the fixed pocket wall, when viewed from the perspective of a person facing the newspaper bearing face of the fixed wall. It should be noted that because a conventional newspaper has an extended lap on the headline side, the side gripper will grip only the headline side of the newspaper. Preferably, the "right side" gripper is actuated at substantially the same time that the brush is biasing the newspaper, so that the gripper will secure the top side of all sections of the newspaper, and the newspaper will be open at its fold, as illustrated in FIG. 1(A), step C. If the conventional newspaper has no lap, then the actuation of the gripper is preferably delayed until after the brush disengages from the newspaper so that the newspaper will open. As is known in the art, with a no-lap newspaper, it is possible and acceptable if the newspaper does not open in the center.

For an asymmetric newspaper fed headline up, the side gripper closest to the spine of the newspaper will be the side gripper located on the left side of the fixed pocket wall, when viewed from the perspective of a person facing the newspaper bearing face of the fixed wall. In accordance with an embodiment of the present invention, the left-side side gripper is actuated after the brush disengages from the newspaper so that it will only grip the last section of the newspaper, having back 1.11, as shown in step C of FIG. 1(D).

While the suction opening(s) on the fixed wall has captured the appropriate section of the newspaper, the suction opening (s) on the moveable wall are actuated and the moveable wall begins to pivots away from the fixed pocket wall, so that the adjacent side of the newspaper paper moves with it. The appropriate fixed wall gripper is then actuated to capture only the section being held by the fixed wall suction opening while the movable wall is moving the remaining sections away from the fixed wall. If a conventional newspaper is in the pocket, the bottom half of the newspaper will move with the moveable wall so that the newspaper will open along its fold as shown in FIG. 1(A), step C. If an asymmetrical paper is in the pocket, the remaining sections of the top (headline) side will move with the movable wall, opening the newspaper between the last section and the next to last section as shown in FIG. 1(D), step C.

Following actuation of the side gripper and movement of the movable wall, the center gripper is moved into contact with the newspaper portion held to the fixed wall in order to prevent movement of the newspaper. Since the newspaper has now been opened, either along the fold in the case of a conventional paper with a lap, or between the last section(s) and prior sections in the case of an asymmetric paper, the center gripper can extend lower along the fixed wall than the side grippers.

An exemplary embodiment of the pocket and pocket conveyor will now be described with reference to FIGS. 3(*a-c*) and 4(*a-b*).

Figure 3A:
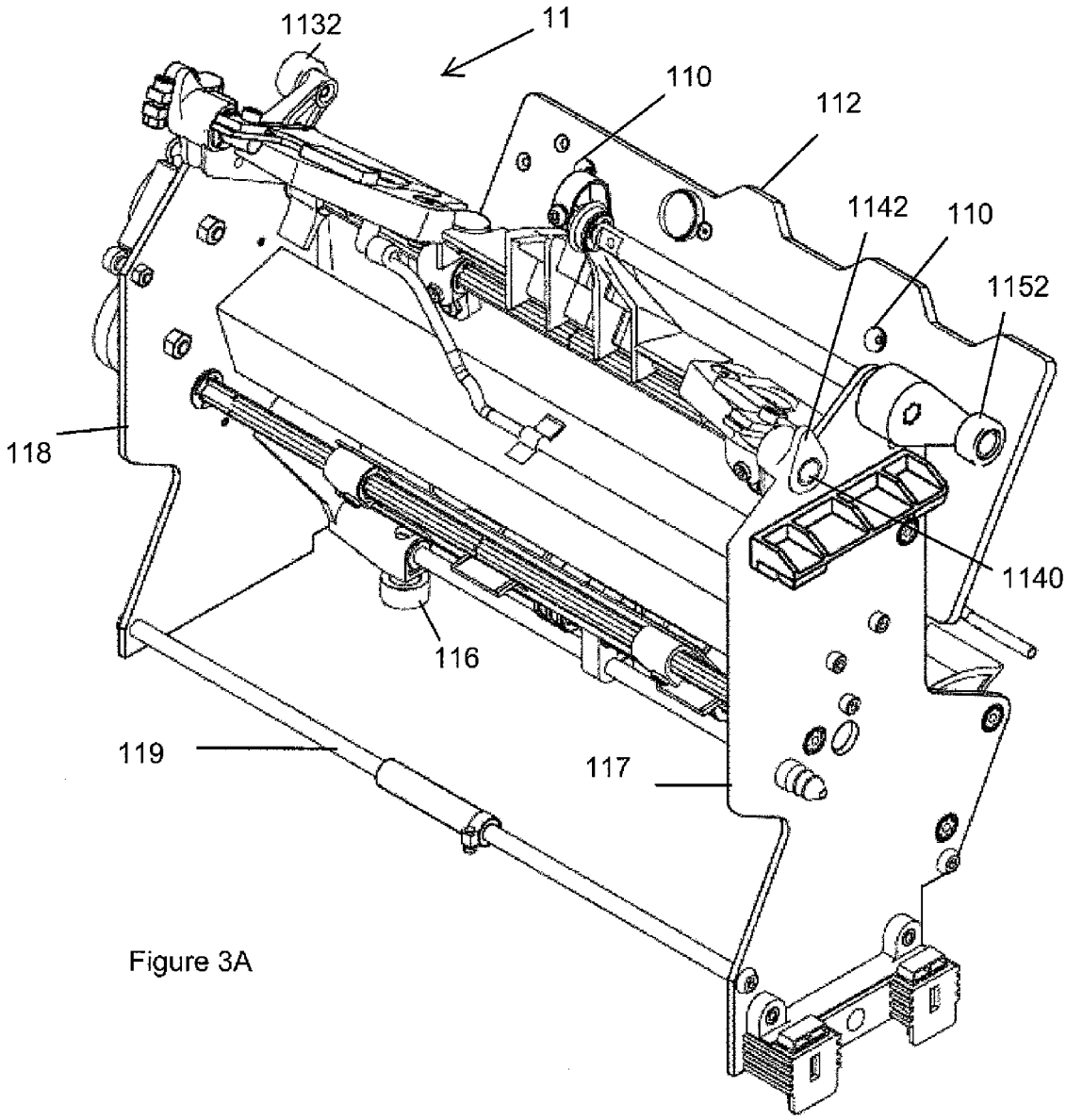
FIG. 3(*a*) shows a perspective view of a pocket in accordance with an embodiment of the present invention from a perspective upstream of the pocket.
Figure 3B:
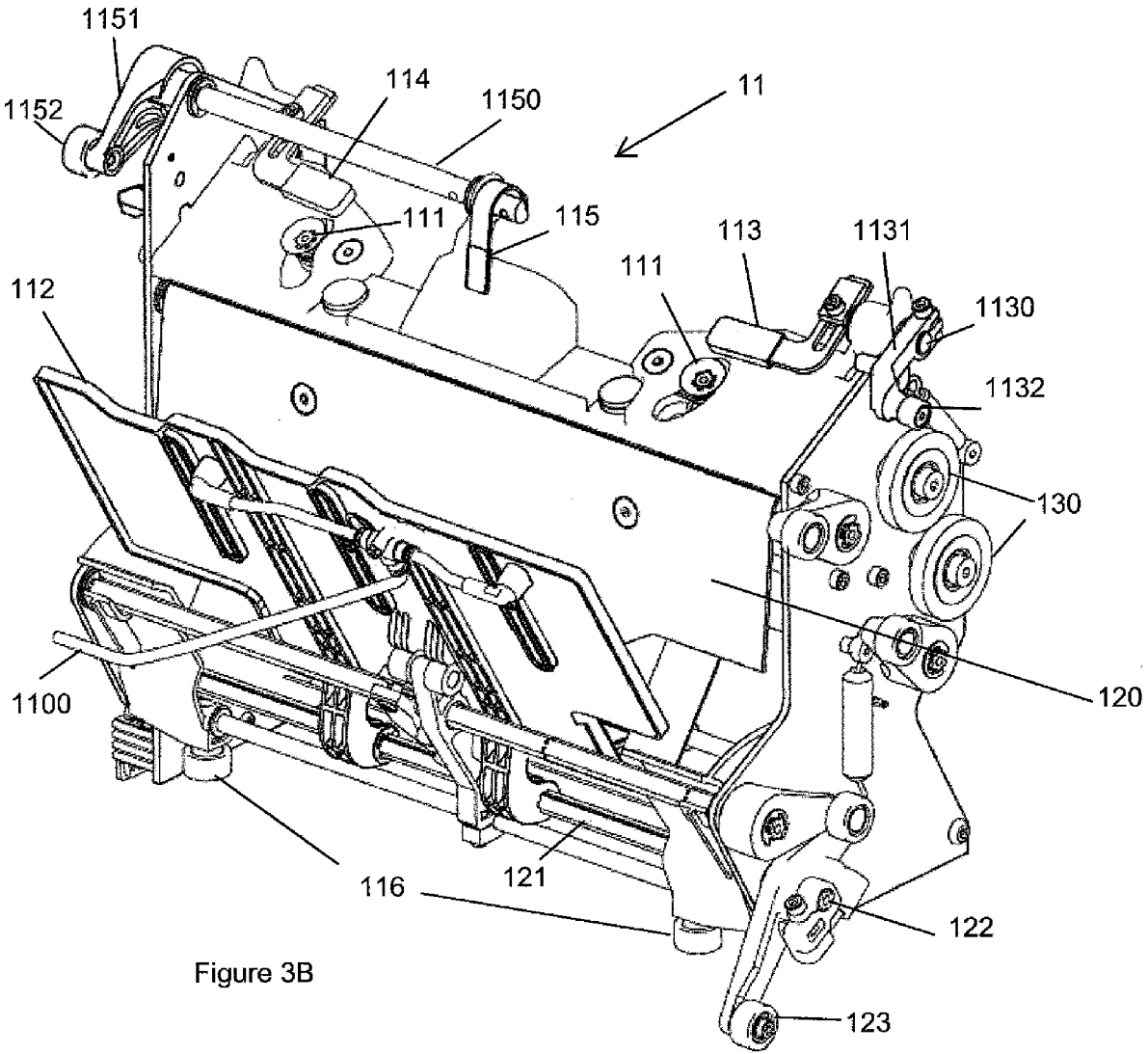
Figure 3C:
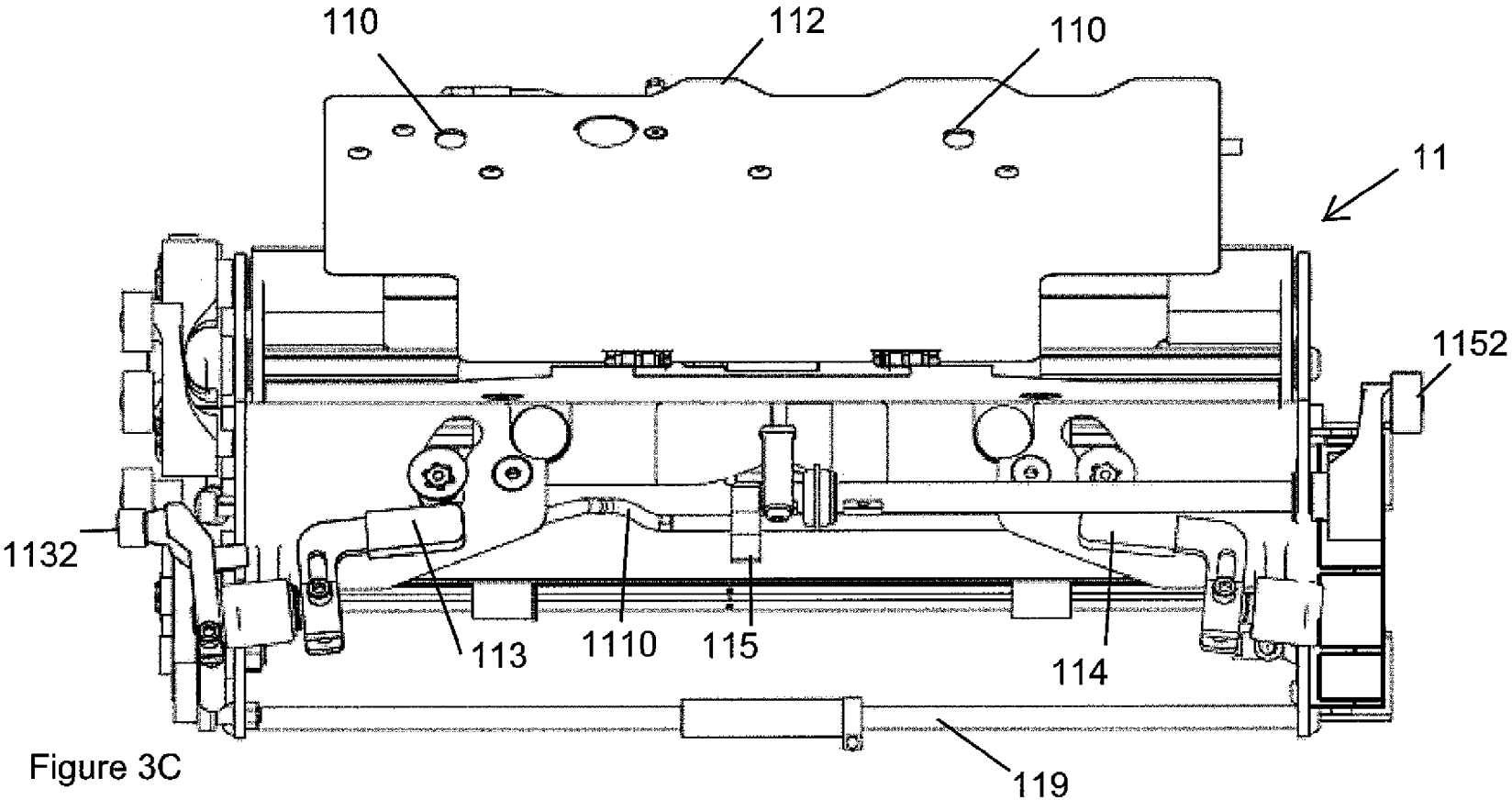
Figure 4A:
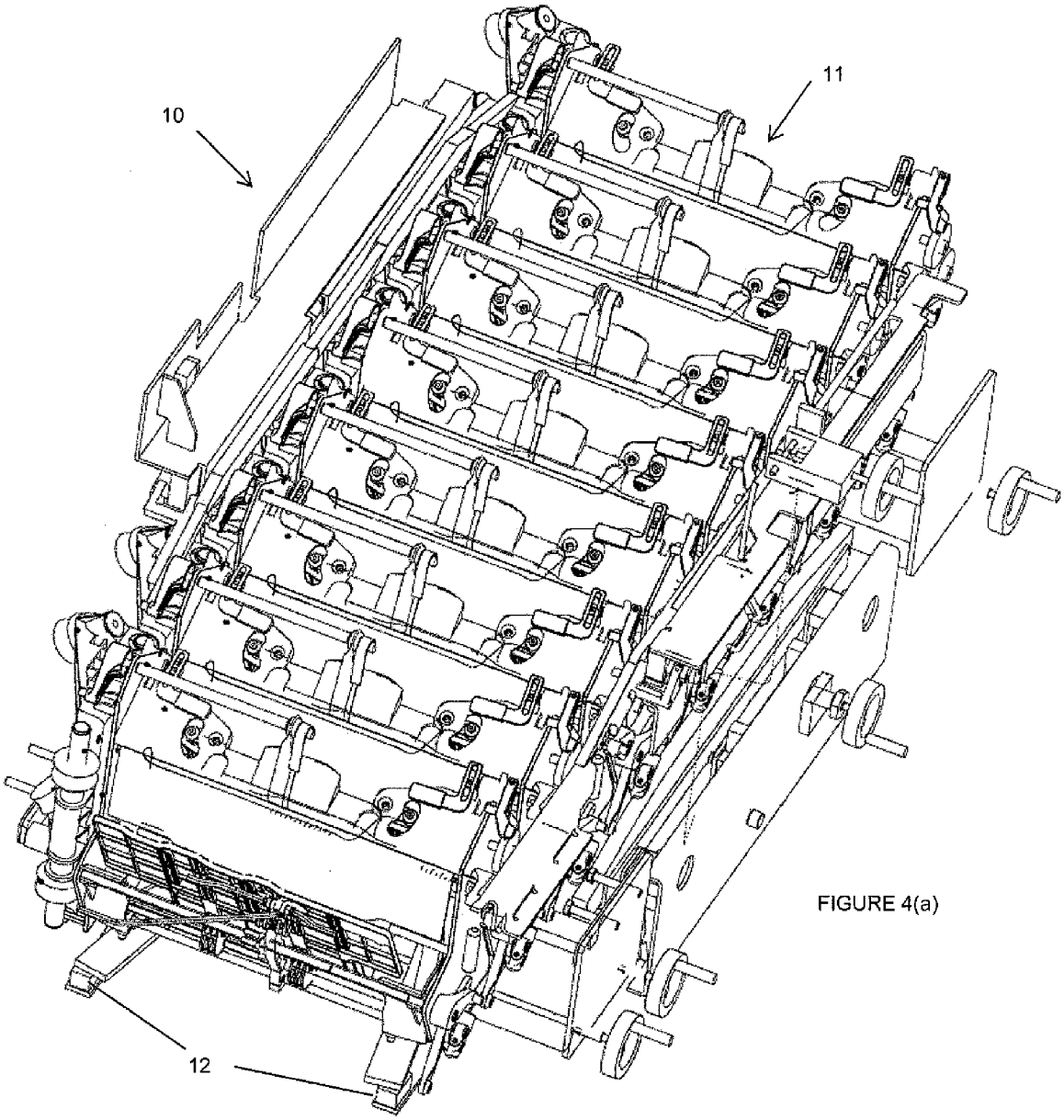
FIG. 4(*a*) shows a top perspective view of eight interconnected pockets of FIGS. 3(*a*) through 3(*c*).
Figure 4B:
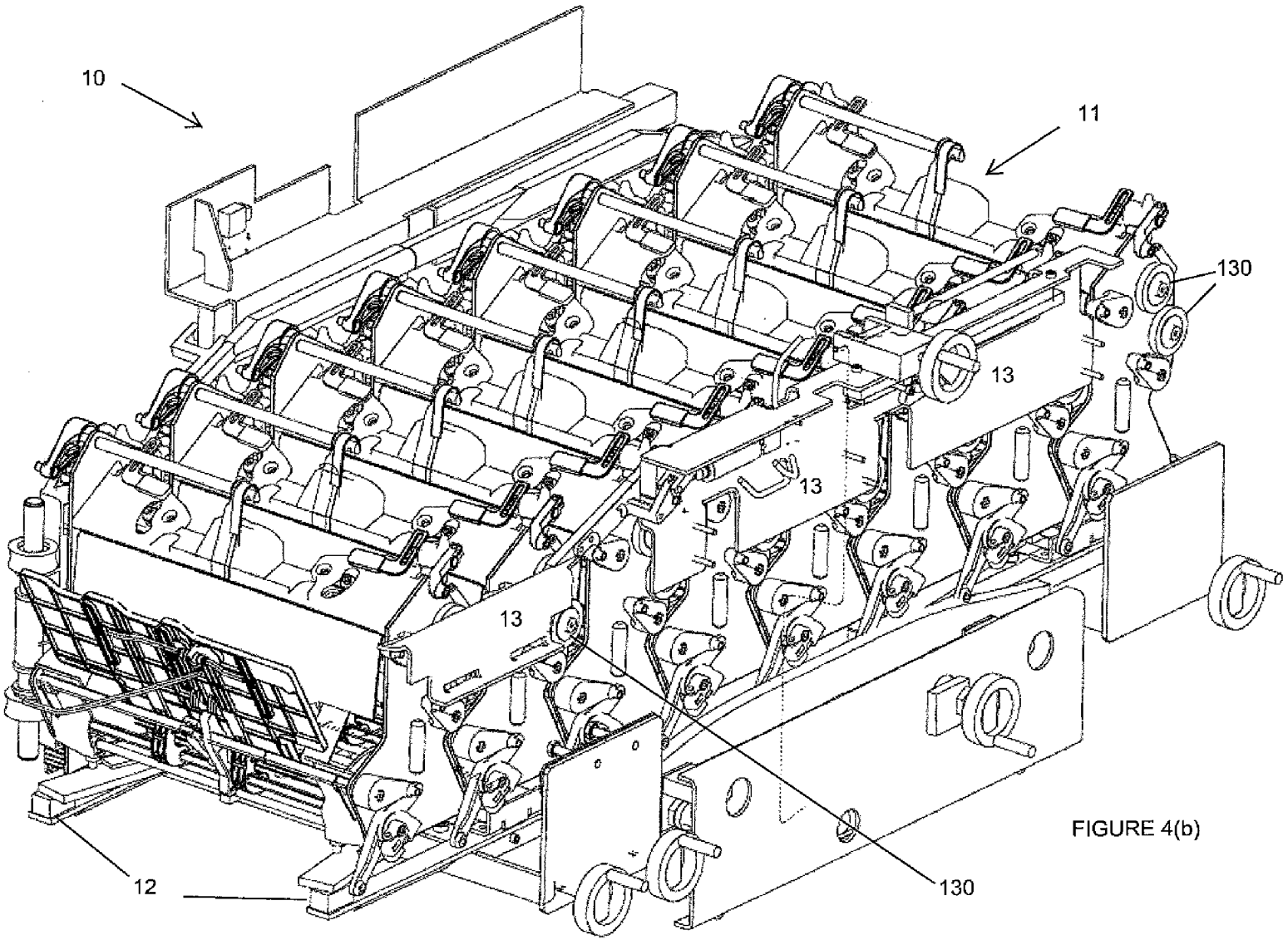

FIG. 3(*a*) shows a perspective view of a pocket 11 in accordance with an embodiment of the present invention from the perspective of a person viewing the pocket from a position upstream of the pocket 11. FIG. 3(*b*) shows a perspective view of the pocket 11 of FIG. 3(*a*) from a perspective which is downstream of the pocket 11. FIG. 4(*b*) shows a portion of pocket conveyor 10, including eight pockets 11 mounted for movement on rails 12, from a downstream perspective. FIG. 3(*c*) shows a top view of the pocket 11 of FIG. 3(*a,b*), and FIG. 4(*a*) shows a top perspective view of a portion of pocket conveyor 10, including eight pockets 11 mounted for movement on rails 12.

Referring to FIGS. 3(*a*) through 3(*c*), pocket 11 includes a fixed wall 120 which, as described below, will support a leading side of the newspaper, and a moveable wall 112 which, as described below, will support the trailing side of the newspaper. Fixed wall 120 has a pair of suction openings 111 supplied by vacuum line 1110, and moveable wall 112 has a pair of suction openings 110 supplied by vacuum line 1100.

Preferably, a suction opening is provided on fixed pocket wall between about 4 mm and about 25 mm from the spine of the newspaper. This is advantageous because by locating the suction opening close to the spine in this manner, the suction opening will hold the entire section of the newspaper against the fixed wall without the inside pages flapping open. Thus, for the exemplary pocket 11 of FIG. 3(*a-c*), which can process newspapers fed headline up or headline down, two suction openings are preferably provided on the pocket 11, one between about 4 mm and about 25 mm from the spine of a newspaper a newspaper fed headline up into the pocket, and another one between about 4 mm and about 25 mm from the spine of a newspaper a newspaper fed headline down into the pocket. However, it is possible, for example, to provide a single suction opening in the center of pocket 11, although this may not hold the entire newspaper section as securely. The suction openings on the movable pocket wall can be located in the same manner.

Pocket 11 has a first side frame 118 and a second side frame 117 which fixedly support fixed wall 120. Support rod 119 provides additional lateral support for frames 117 and 118. First side frame 118 and second side frame 117 also support moveable wall 112 through shaft 121 which is rotatable within frame 117 and 118 around axis 122. Moveable wall 112 is fixedly mounted to shaft 121, and is moveable under the control of cam follower 123.

Pocket 11 includes three grippers (113, 114, 115) for gripping the newspapers 1 or 1' during the inserting process. First side gripper 113 is fixedly connected to shaft 1130, and shaft 1130 is rotatably mounted in side frame 118. Shaft 1130 is connected to cam follower 1132 through lever 1131. Second side gripper 114 is fixedly connected to shaft 1140, and shaft 1140 is rotatably mounted in side frame 117. Shaft 1140 is connected to cam follower 1142. Center gripper 115 is fixedly connected to shaft 1150, and shaft 1150 is rotatably mounted in side frame 117. Shaft 1150 is connected to cam follower 1152 through lever 1151.

Referring to FIGS. 4(*a*) and 4(*b*), pockets 11 are movable on rails 12 via a pair of rollers 116 on each pocket. The pockets 11 are also movably supported on guides 13 via rollers 130.

The manner in which the pocket conveyor of FIGS. 3(*a-c*) and 4(*a-b*) operates to process conventional newspapers headline down, and asymmetrical newspapers headline up will now be described.

The newspapers are fed into the pockets in any known manner. For example, they can be fed into the pockets by a jacket hopper, or can be dropped into the pockets directly from an upstream gripper conveyor. Once the newspaper is in the pocket, the newspaper is opened in an opening section of the inserter. FIG. 4(*a, b*) show a portion of the pocket conveyor in an opening section of the inserter.

Referring to FIGS. 3(*b*) and 3(*c*), when a pocket 11 reaches the opening section of the inserter, the rotating brush in the opening section biases the newspaper against the top half of fixed pocket wall 120 and the suction openings 1101 on the fixed pocket wall 120 are actuated, e.g. by a vacuum valve (not shown) connected to vacuum supply line 1110, so that an adjacent side of the newspaper is held to the fixed pocket wall 120 by the vacuum.

Referring to FIGS. 1(*a*) and 3(*b*), if a conventional newspaper was fed headline down into the hopper, when the suction openings 1101 on the fixed pocket wall 120 are actuated, the face of the headline side 1.1 of the newspaper will be held to the fixed pocket wall 120. Referring to FIGS. 1(*e*) and 3(*b*), if an asymmetrical newspaper was fed headline up into the hopper, when the suction openings 1101 on the fixed wall 120 are actuated and the back 1.11 of the headline side 1.1 will be held to the fixed pocket wall 120 because the suction openings 1101 are placed on the top half of the fixed pocket wall. In this regard, in the example of FIG. 3(*a-c*) the top half of the fixed pocket wall 120 is angled respect to the bottom half of the pocket wall. In FIG. 3(*b*), it can be seen that in the exemplary pocket 11, the bottom and top halves of fixed wall 120 form an obtuse angle, of for example, between 110 and 130 degrees.

Then, either the first side gripper 113 or the second side gripper 114 is actuated, depending on whether the newspaper is conventional or asymmetric. In this regard, the side gripper closest to the spine of the newspaper is actuated.

For a conventional newspaper fed headline down, first side gripper 113 will be actuated via cam follower 1132. For a conventional newspaper fed headline down, this will be the side gripper 113 located on the right side of the fixed pocket wall, when viewed from the perspective of a person facing the newspaper bearing face of the fixed wall. It should be noted that because a conventional newspaper has an extended lap on the headline side, the side gripper 113 will grip only the headline side of the newspaper. Preferably, the gripper 113 is actuated at substantially the same time that the brush is biasing the newspaper, so that the gripper will secure the top side of all sections of the newspaper, and the newspaper will be open at its fold (in the center), as illustrated in FIG. 1(A), step C. If the conventional newspaper has no lap, then the actuation of the gripper is preferably delayed until after the brush disengages from the newspaper so that the newspaper will open. As is known in the art, with a no-lap newspaper, it is possible and acceptable if the newspaper does not open at the fold but after the first section only.

For an asymmetric newspaper fed headline up, the side gripper closest to the spine of the newspaper will be second side gripper 114, actuated by cam follower 1142 (which may be identical in construction with cam followers 1132 and 1152). As explained above, the brush of the opener will bias all of the top sections 1.1 against the upper half of fixed pocket 120, with the back 1.11 of the last section of the newspaper resting against the suction openings 1101. However, for an asymmetrical newspaper to be opened, one or more of the preceding sections of the newspaper must move towards the movable pocket wall so that the newspaper will be open to receive inserts. As such, the left-side side gripper 114 is actuated after the brush disengages from the newspaper so that it will not grip at least the first section of the newspaper. Typically, the gripper will only grip the last section of the newspaper, having back 1.11 which is directly secured to the vacuum opening, as shown in step C of FIG. 1(D).

As one of ordinary skill in the art will appreciate, there are a multitude of techniques that could be used to control the timing of the gripper movement. For example, if a gripper is controlled by a cam follower as shown in the drawings, the timing of the gripper movement can be controlled via placement of the cam relative to the brush in the opening section.

After the brush disengages from the newspaper, the suction openings 110 on the moveable wall 112 continue to be actuated and the moveable wall 112 pivots away from the fixed pocket wall, so that the adjacent side of the newspaper paper moves with it. Again, the suction openings 110 are supplied by vacuum line 1100, and the vacuum can be applied and removed via a valve (not shown), for example. If a conventional newspaper is in the pocket 11, the bottom half of the newspaper will move with the moveable wall so that the newspaper will open along its fold as shown in FIG. 1(*a*), step C. If an asymmetrical paper is in the pocket 11, the remaining sections of the top (headline) side will move with the movable wall, opening the newspaper between the last section and the next to last section as shown in FIG. 1(*d*), step C.

Following actuation of the side gripper (113 or 114) and movement of the movable wall 112, the center gripper 115 is moved into contact with the newspaper portion held to the fixed wall 120 in order to prevent movement of the newspaper. As explained above, movement of the center gripper is effected with cam follower 1152. Since the newspaper has now been opened, either along the fold in the case of a conventional paper, or between the last section(s) and prior sections in the case of an asymmetric paper, the center gripper 115 can, though need not, extend lower along the fixed wall than the side grippers (113, 114).

As described above, an inserting machine includes a pocket conveyor which moves under a plurality of hoppers or feeders. If the newspaper jacket (main sections of the newspaper) is to be fed from a hopper (also known as a feeder), then a jacket feeder (hopper) may be used to feed the newspaper jackets into the moving pockets. Alternatively, the newspaper jacket may be dropped directly into moving pockets from a gripper conveyor, as is well known in the art. In any event, after the newspaper jacket is opened in the opening section as described above with respect to FIGS. 3(*a-c*) and 4(*a-b*), inserts are fed into the pockets from insert feeders (hoppers). In this regard, an insert feeder (hopper) can be of the same construction as a jacket feeder (hopper). Typical feeders (hoppers) include a tray for holding the newspaper jackets or inserts, and a gripper drum for feeding the jacket or insert from the tray to the pocket. One such feeder is shown in U.S. Pat. No. 6,082,724, incorporated by reference. Other types of feeding mechanisms can also be used.

In any event, once the inserts have been fed into the newspapers in the pockets 11, the newspapers are released through the bottom of the pocket 11 to grippers 21 of a gripper conveyor 20 traveling below a delivery section of the pocket conveyor as shown in FIG. 2(*a*). Any known mechanism can be used to release the newspapers from the pocket, in the pocket 11 shown in FIG. 3*b*, the top of the movable pocket wall first rotates back towards the fixed pocket wall under the control of shaft 121 and cam follower 123 to close the newspaper, and then the bottom of the movable pocket wall moves away from the fixed pocket wall releasing the newspapers as shown in FIG. 2(*a*). As mechanisms for implementing a bottom opening pocket are well known, they will not be described herein. In any event, the newspapers are then transported by gripper conveyor 20 to lap conveyor 30, and the asymmetrical newspapers are placed headline up on the lap conveyor 30.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method for transporting and opening newspapers for inserting, comprising:

feeding an asymmetrically folded multiple section newspaper into a pocket of a pocket conveyor of an inserting machine, wherein the asymmetrically folded multiple section newspaper has an extended lap having a height of at least 15% of a height of the asymmetrically folded newspaper when unfolded, a face of a first section of the headline side of the newspaper adjacent a movable wall of the pocket, a back of a last section of the headline side of the newspaper adjacent a fixed wall of the pocket;

applying a vacuum from a suction opening on the fixed pocket wall, thereby holding a last section of the headline side of the newspaper against the fixed wall of the pocket;

moving a first side gripper mounted on the pocket to secure the last section the headline side of the newspaper against the fixed wall of the pocket;

moving the movable pocket wall away from the fixed pocket wall while applying a vacuum from a suction opening on the movable pocket wall, thereby holding at least the first section of the headline side of the newspaper against the movable pocket wall;

feeding one or more inserts from a hopper to the pocket, the inserts fed into an opening between newspaper sections;

removing the newspapers with the inserts therein from the pocket with a gripper conveyor; and releasing the newspapers with the inserts from the gripper conveyor headline up on a lapped stream conveyor.

2. The method of claim 1, wherein the asymmetrically folded multiple section newspaper has an extended lap having a height of no more than about 90% of a height of the asymmetrically folded newspaper when unfolded.

3. The method of claim 1, wherein the step of applying a vacuum from a suction opening on the fixed pocket wall further comprising biasing the asymmetrically folded newspaper against the suction opening with a rotating brush mounted in an opening section of the inserting machine.

4. The method of claim 1, further comprising, after moving the first side gripper, moving a center gripper mounted on the pocket to secure the last section the headline side of the newspaper against the fixed wall of the pocket.

5. The method of claim 4, wherein the step of moving the center gripper occurs after the step of moving the movable pocket wall.

6. The method of claim 1, wherein the pockets further include a second side gripper mounted thereon, and wherein the method further comprises:

feeding a non-asymmetrically folded multiple section newspaper into a pocket of a pocket conveyor of an inserting machine, wherein the non-asymmetrically folded multiple section newspaper has an extended lap having a height of less than 15% of a height of the non-asymmetrically folded newspaper when unfolded, a face of a top of a first section of the headline side of the newspaper adjacent the fixed wall of the pocket, a face of a bottom of the headline side of the first section adjacent the moveable wall of the pocket;

applying a vacuum from a suction opening on the fixed pocket wall, thereby holding the top of the first section of the headline side of the newspaper against the fixed wall of the pocket;

moving the second side gripper to secure the top of the first section the headline side of the newspaper against the fixed wall of the pocket;

moving the movable pocket wall away from the fixed pocket wall while applying a vacuum from a suction opening on the movable pocket wall, thereby holding at least the bottom of the first section of the headline side of the newspaper against the movable pocket wall, thereby opening the newspaper;

feeding one or more inserts from a hopper to the open jacket in the pocket, the inserts fed into the open newspaper;

removing the newspapers with the inserts therein from the pocket with a gripper conveyor; and releasing the newspapers with the inserts from the gripper conveyor headline down on a lapped stream conveyor.

7. The method of claim 6, wherein the steps of applying a vacuum from a suction opening on the fixed pocket wall further comprising biasing the asymmetrically and non-asymmetrically folded newspapers against the suction opening with a rotating brush mounted in an opening section of the inserting machine.

8. The method of claim 1, wherein the first side gripper grips a spine side of the asymmetrically folded newspapers.

9. The method of claim 6, wherein the first side gripper grips a spine side of the asymmetrically folded newspapers, and wherein the second side gripper grips a spine side of the non-asymmetrically folded newspapers.

10. The method of claim 6, wherein the second side grippers are not actuated while asymmetrically folded newspapers are in the pockets, and the first side grippers are not actuated while non-asymmetrically folded newspapers are in the pockets.

11. The method of claim 1, wherein the suction opening on the fixed pocket wall is located between about 4 mm and about 24 mm from a spine of the asymmetrically folded newspaper.

* * * * *